US009123461B2

(12) United States Patent
Carsten

(10) Patent No.: US 9,123,461 B2
(45) Date of Patent: Sep. 1, 2015

(54) RECONFIGURING TAPE WOUND CORES FOR INDUCTORS

(75) Inventor: Bruce W. Carsten, Corvallis, OR (US)

(73) Assignee: Peregrine Power, LLC, Wilsonville, OR (US)

( * ) Notice: Subject to any disclaimer, the term of this patent is extended or adjusted under 35 U.S.C. 154(b) by 122 days.

(21) Appl. No.: 13/438,809

(22) Filed: Apr. 3, 2012

(65) Prior Publication Data

US 2013/0257578 A1 Oct. 3, 2013

(51) Int. Cl.

| | |
|---|---|
| ***H01F 3/14*** | (2006.01) |
| ***H01F 27/25*** | (2006.01) |
| ***H01F 41/02*** | (2006.01) |

(52) U.S. Cl.

CPC ..... *H01F 3/14* (2013.01); *H01F 27/25* (2013.01); *H01F 41/0213* (2013.01); *Y10T 29/4902* (2015.01)

(58) Field of Classification Search

USPC ..... 336/233, 234, 213, 178, 212

See application file for complete search history.

(56) References Cited

U.S. PATENT DOCUMENTS

| | | | | |
|---|---|---|---|---|
| 4,520,556 | A * | 6/1985 | Pasko et al. | 29/606 |
| 4,599,595 | A * | 7/1986 | Geschka | 336/178 |
| 4,603,314 | A * | 7/1986 | Fukunaga et al. | 336/65 |
| 4,922,156 | A * | 5/1990 | Turcotte et al. | 315/244 |
| 6,070,317 | A * | 6/2000 | Allen et al. | 29/609 |
| 6,668,444 | B2 * | 12/2003 | Ngo et al. | 29/606 |
| 7,846,306 | B2 * | 12/2010 | Hafezi et al. | 204/230.7 |
| 8,106,738 | B2 * | 1/2012 | Sin | 336/196 |
| 2004/0178877 | A1 * | 9/2004 | Lin | 336/234 |
| 2006/0066433 | A1 * | 3/2006 | Decristofaro et al. | 336/212 |
| 2009/0295524 | A1 * | 12/2009 | Silva | 336/170 |
| 2010/0171580 | A1 * | 7/2010 | Abe et al. | 336/178 |

* cited by examiner

*Primary Examiner* — Elvin G Enad
*Assistant Examiner* — Kazi Hossain
(74) *Attorney, Agent, or Firm* — Steven J. Sullivan

(57) ABSTRACT

A tape wound inductor core device, inductors including same and methods of manufacture. Tape wound material may be cut and/or shaped into "pucks" that have an exterior surface made up of or defined substantially by the edge surfaces of the layers of the constituent conductive material, with all or most of the broad surfaces disposed inwardly, thereby reducing eddy currents and associated losses. Various puck configurations, inductor arrangements and fabrication techniques are disclosed.

25 Claims, 8 Drawing Sheets

RECONFIGURING TAPE WOUND CORES FOR INDUCTORS

FIELD OF THE INVENTION

The present invention relates to electric inductors and, more specifically, to the configuration of a tape wound core proximate an air gap in the core of these inductors.

BACKGROUND OF THE INVENTION

Inductors are used in power converters to store energy in a magnetic field during one part of an operating cycle, and to return all or part of that energy during another part of the cycle. Such inductors are typically comprised of a winding on an easily magnetized or "ferromagnetic" core. One or more so-called "air gaps" in the core are usually required to maximize the energy which can be stored in the inductor. These air gaps may be 'distributed' throughout the core, in such materials as "powdered iron" type cores, or may consist of one or more 'discrete' air gaps in the core. The faces of a discrete air gap in an inductor are conventionally flat, parallel to each other, and at right angles to the surface of the core outside the air gap.

Various inductor core materials and configurations are known in the art. These materials include silicon-steel (Si-steel) in laminated or tape wound form, ferrite, and amorphous and nanocrystalline alloys in tape wound form, with benefits and drawbacks to each of these materials in various applications. The present invention applies to tape wound type inductor cores with one or more intentional discrete air gaps in the magnetic path, and with an alternating current (AC) in a conventional winding (not always shown in figures) on the core, and the resultant AC flux in the core.

The distinction between core laminations and tape is largely based on thickness and the method of assembly. Core laminations are relatively thick, typically greater than 0.1 mm, and are stacked or assembled flat. Core tape materials are generally somewhat thinner than 0.1 mm, and are typically wound around a suitable form or mandrel to provide the desired shape. Sections of wound tape cores may be cut out and reassembled to form new shapes, as noted in [1].

The energy storage capability of an inductor is influenced significantly by the length of the air gap(s) in its core, there being an optimum air gap length at which the maximum core flux and winding current occur simultaneously, and where energy storage is at a maximum. A "fringe" flux field develops adjacent (but external) to such an air gap, extending from the surfaces of the core on one side of the gap to that of the other side. This fringe field is strongest at the edge of the air gap, and drops off approximately inversely with distance from the center of the air gap.

Referring to FIG. 1A, a perspective view of a conventional inductor core 110 that illustrates this flux fringe field 150 is shown for one surface of the core. A problem associated with an AC flux fringe field is that, as noted in references [2], [3] and [4], at high frequencies and/or flux densities the fringe field 150 induces large eddy currents 117, 118 to flow on the broad surfaces 119, 120 of the tape core sections 112, 114. These eddy currents induce losses in the core near the air gap, as illustrated by the shaded regions 122 and 132 in FIG. 1B. These losses reduce the ability of the inductor to store and return energy at high frequencies, as the losses are proportional to the square of the induced eddy currents, and thus of both the AC flux density and the frequency. The overall result is a significantly lower allowable maximum power density (rate of energy storage and recovery) for the inductor before overheating occurs. (A similar fringe field enters the core on the edges of the tape, but this field does not induce excess eddy currents in the core.)

In the related field of Si-steel laminated core transformers, prior art attempts to reduce similar broad core surface eddy currents from the leakage flux field between primary and secondary windings entering the core are known. In this attempt, slots were made in the broad surfaces of the core laminations near the ends of the windings where the leakage flux would enter the core on the broad surface of the laminations. Application of this prior art technique to inductor cores is illustrated in FIG. 2, as taught by the inventor in [5], where slots 287 are cut into the broad surfaces of the laminated core sections 212, 214 near the air gap 226. These slots 287 'break up' the eddy currents, as shown by the eddy currents paths in phantom 227, 228, at the ends of the illustrative flux line 261, reducing their magnitude and the associated losses.

Disadvantageous aspects of this approach include that it is not readily ascertained how long, deep or frequent the slots should be, nor on how to make them. Another disadvantageous aspect is that it is difficult to cut or otherwise form slots in laminated or tape wound material without creating electrical shorts between the cut layers, which increase eddy current losses.

Another prior art approach to minimizing the fringe field losses in Si-steel laminated cores was developed for large "shunt reactors" used in the power transmission industry [6]. This is shown in FIG. 3. The accompanying description states that "The [lamination] sheets are stacked tightly together to form "wedge" sections, which are inserted into a circular base to create each core element. Radial lamination [sic] prevents fringing flux from entering the flat surfaces of core-steel, eliminating eddy current, overheating and hot spots." FIG. 3A shows such an arrangement 300 of wedge sections 310 of laminations 315, which become a cylindrical "core element" 320 (FIG. 3B), which are stacked with spacers to form a "gapped core" 340 (FIG. 3C). In FIG. 3D, a complete inductor 350 is formed by adding winding 352 around the gapped core, and core field return yoke 355. An enlargement of the gapped core near the edge (FIG. 3E) shows the fringe field flux, near the air gap, entering the core element 320 at the lamination 315 edges.

Disadvantageous aspects of this approach include that it is labor intensive, and thus expensive, and is not feasible for the thin tapes used in tape wound cores, which are on the order of 25 micron (or 0.001") thick for amorphous and nanocrystalline tape materials.

A need thus exists to reduce fringe field induced losses in a tape wound inductor core and, furthermore, to do so in a manner that is practical, effective, and economical, and that provides consistent and predictable results.

Ferrite and Nanocrystalline

Ferrite is a well-known inductor core material and has been one of the principal core materials of choice for frequencies above about 5 to 10 kHz due to low hysteressis and eddy current losses. Modern nanocrystalline materials, however, have lower hysteressis losses than ferrites up to about 200 kHz and can operate with 1.6 times the ac flux at 40 kHz and twice the ac flux at 20 kHz for the same loss (based on published data). Furthermore, the nanocrystalline material's saturation flux density $B_{SAT}$ is about 3 times that of ferrites at elevated temperatures of 80-100 degrees C. (1.2 Tesla v. 400 mT). Ferrite, on the other hand, has the advantage of being an isotropic ceramic material, and thus ferrite cores do not exhibit the excess eddy current losses near an air gap experienced by laminated and tape wound metallic core materials.

A need further exists to provide inductors of significantly smaller size, for example, by taking advantage of the properties of nanocrystalline material (or other similar materials yet to be developed) to improve the overall power densities of switching converters, particularly when inductor currents include DC or low frequency (e.g., 50 Hz or 60 Hz) AC currents significantly greater than the allowable high frequency AC ripple current.

SUMMARY OF THE INVENTION

Accordingly, it is an object of the present invention to minimize or eliminate eddy current losses induced in tape wound cores by the flux fringe fields near a core air gap.

It is another object of the present invention to allow inductors of smaller size and/or lower mass to be produced due to the reduced eddy current losses induced by the fringe fields near core air gaps.

In one embodiment, the present invention may include an inductor core device of square, rectangular or similar cross section where the broad surface of core tape is not substantially exposed on the surface of the core.

In another embodiment, the present invention may include an inductor core device of round cross section where the broad surface of core tape is not substantially exposed on the surface of the core.

In other embodiments, the present invention may include an inductor core device of rectangular, hexagonal, octagonal or other desired cross section where the broad surface of core tape is not substantially exposed on the surface of the core.

These and related objects of the present invention are achieved by cutting sections from tape wound cores, which are reconfigured to leave the broad surface of the tape unexposed on the surface of the core.

The attainment of the foregoing and related advantages and features of the invention should be more readily apparent to those skilled in the art, after review of the following more detailed description of the invention taken together with the drawings.

DEFINITIONS

1) An "air gap" in a core is understood to be a non-magnetic portion of the core, which may consist partially or wholly of material other than air.
2) The "broad surface" of a core tape is the surface with the greater dimensions.
3) A core "puck" is a segment of reconfigured tape wound core used as part of an inductor core.
4) "Saw kerf" is the width of material removed by a saw in cutting, or by other means used to cut a tape wound core into two or more pieces.

DETAILED DESCRIPTION

Figure 1A:
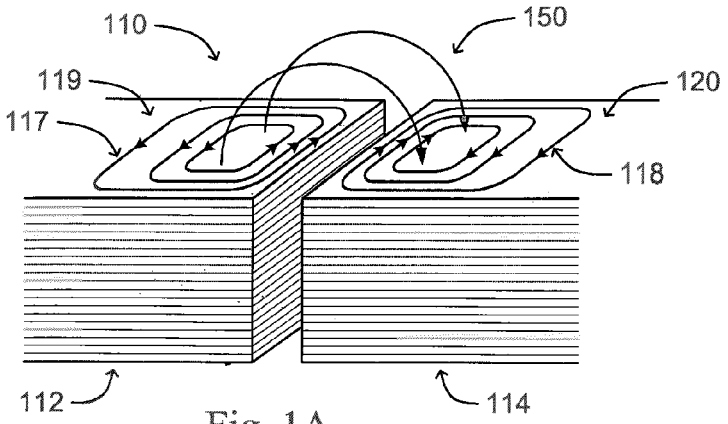
Fig. 1A (Prior Art)
FIG. 1A is an illustration of the eddy currents induced in the broad surface of the laminations or tape in a core with an air gap.
Figure 1B:
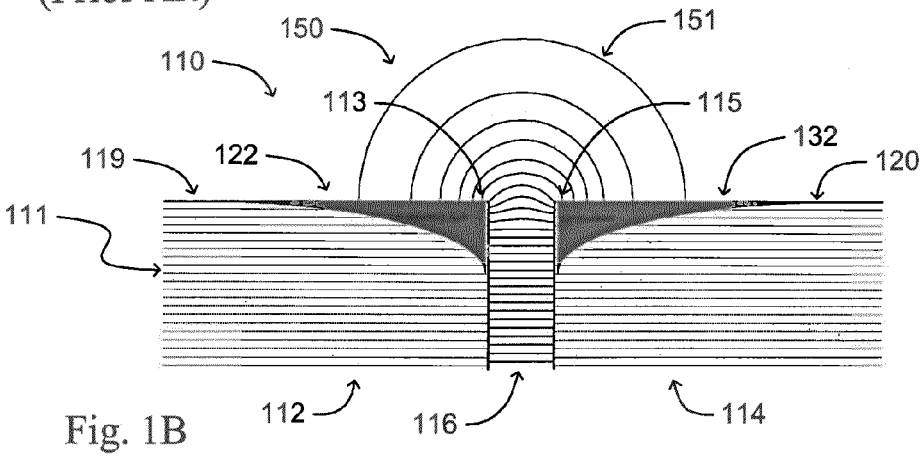
Fig. 1B (Prior Art)
FIG. 1B is an illustration of the losses in a core due to induced eddy currents in the core.
Figure 2:
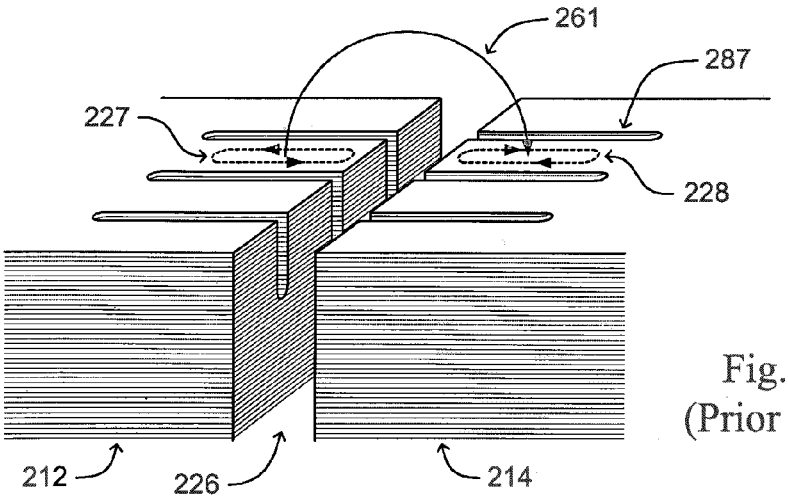
Fig. 2 (Prior Art)
FIG. 2 illustrates a prior art method of reducing the core eddy current losses adjacent to an air gap.
Figure 3A:
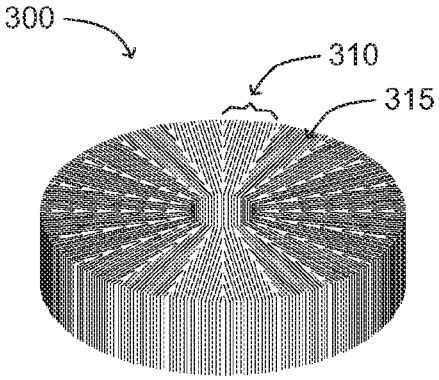
Fig. 3A Prior Art
FIGS. 3A-3E illustrates another prior art method for eliminating the core eddy current losses in laminations adjacent to an air gap.
Figure 3B:
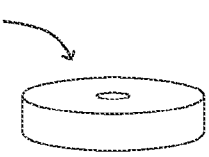
Figure 3C:
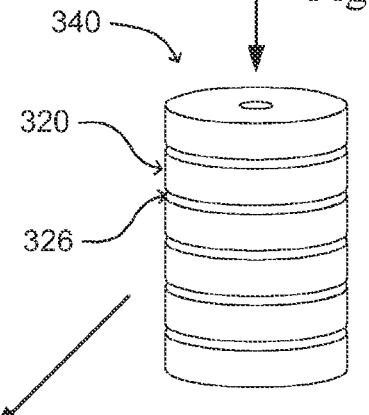
Figure 3D:
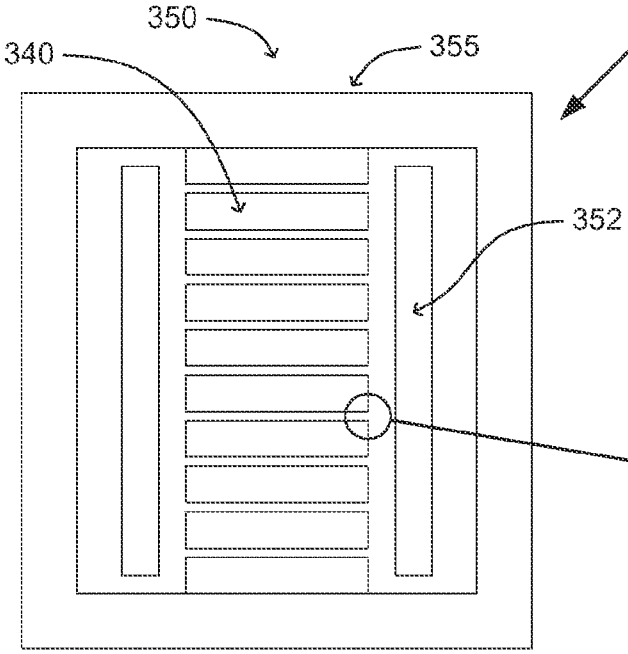
Figure 3E:
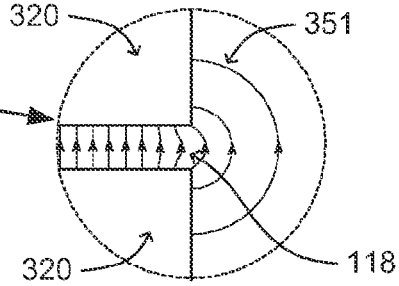

Referring to FIG. 1B, a side view of the air gap near one external surface of a conventional core 110 in a tape wound or laminated inductor is shown. Inductor core 110 includes a first and second section 112, 114 separated by an air gap 116. Each core section is preferably formed of alternating layers of conductive ferromagnetic and relatively thin insulative material. The conductive ferromagnetic layers 111 are shown. It is to be understood that insulating layers separate each of the conductive ferromagnetic layers to minimize eddy currents within the core itself. It is also to be understood that the conductive nature of the ferromagnetic material is an undesirable but currently unavoidable property of such materials, without which eddy current losses in the core would not be a concern.

In use, a magnetic field is produced across air gap 116 and a fringe field 150 develops near the ends of the gap. The arced lines 151 indicate the direction of this field and their increased spacing indicates a weakening of the field away from the gap. Referring back to FIG. 1A, this field forms eddy currents 117, 118 in the broad surfaces 119, 120 of the outer tape or lamination on each of the core sections 112, 114 as noted above. The eddy current in turn produces localized heating in the core sections 112, 114 as indicated by shaded areas 122, 132 in FIG. 1B. This heating is greatest at the corners 113, 115, decreasing essentially as the inverse square of the distance from the center of the air gap 116. Thus it is most important to minimize the induced eddy current losses in the core proximate to an air gap, typically for distances removed from the air gap of several times the length of the air gap.

As described above, this eddy current is disadvantageous in that it reduces the strength of the magnetic field obtainable across the gap for an allowable total power dissipation or temperature rise, and hence the ability of the inductor to store and return energy at a high rate.

Figures 4A, 4B, 4C, 4D:
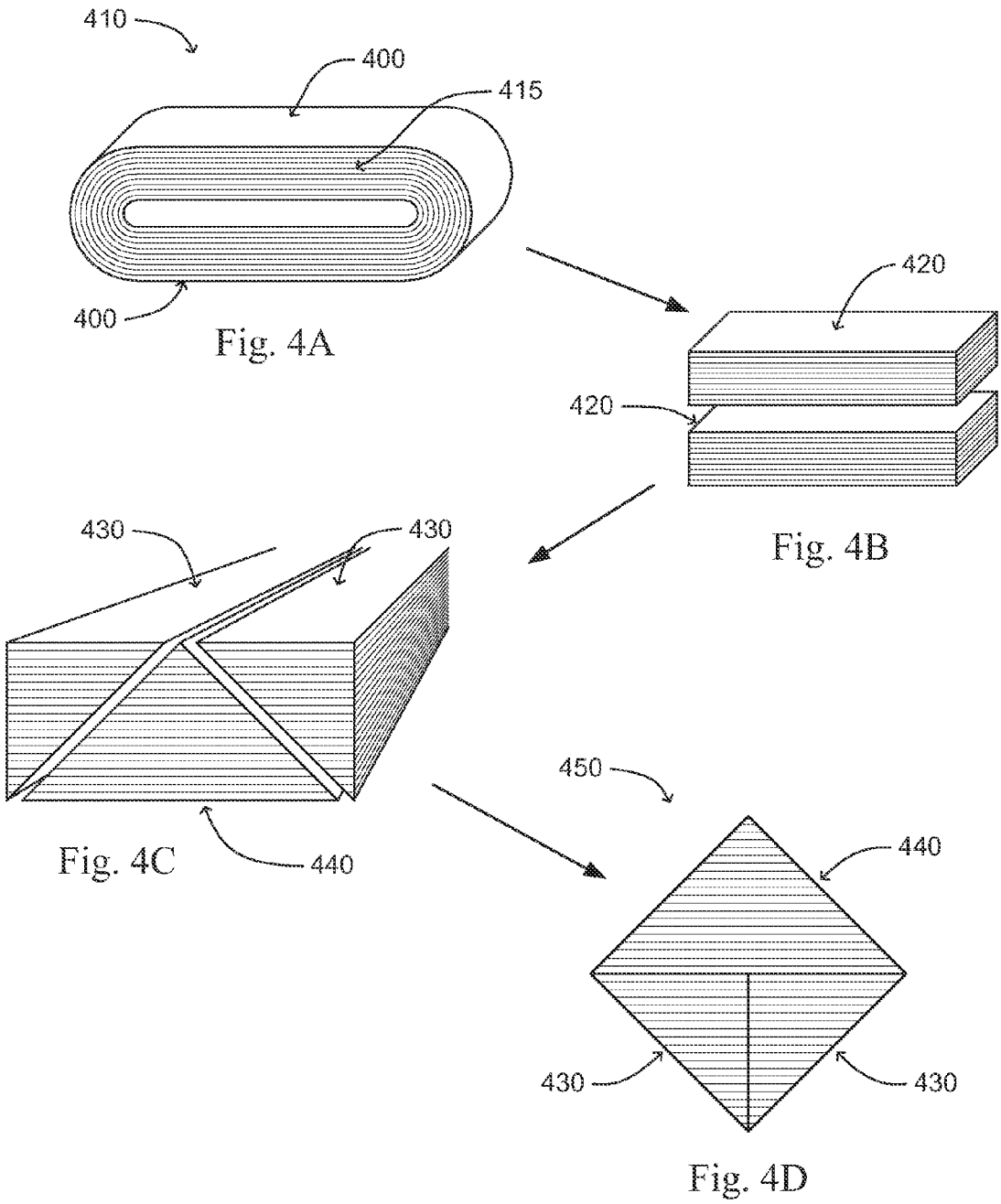
FIGS. 4A-4D is an embodiment of the present invention where a tape wound core is cut into segments and reconfigured as a square core to eliminate the eddy current losses in the core from the fringe field.

Referring to FIGS. 4A-4D, steps in accordance with a preferred embodiment of the invention for reconfiguring a tape wound core to minimize eddy currents near an air gap are shown. In FIG. 4A, tape wound core 410 is made with straight segments 400, with the edges of the tape 415 shown for orientation. In FIG. 4B, bars 420 are cut from the straight segments 400, each bar ideally twice as wide as it is thick (neglecting the width of any "saw kerf"). FIG. 4C shows how the bars are cut or sliced longitudinally at 45 degrees to the tape surface to create right triangle shaped segments 430 and 440. In FIG. 4D, the two smaller triangular segments 430 and the one larger triangular segment 440 are reconfigured to create a square cross section bar 450, where only core tape edges are exposed at the surface of the bar. The triangular segments may be joined with an epoxy adhesive or other means.

Figure 5:
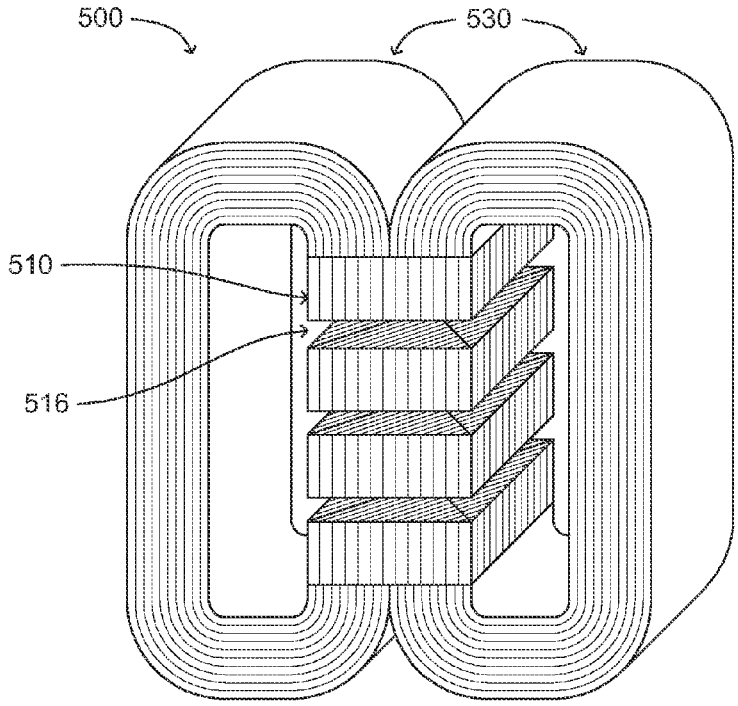
FIG. 5 illustrates how the reconfigured core embodiment of the invention of FIG. 4 may be combined with tape wound "cut cores" to form a complete inductor core.
Figure 6:
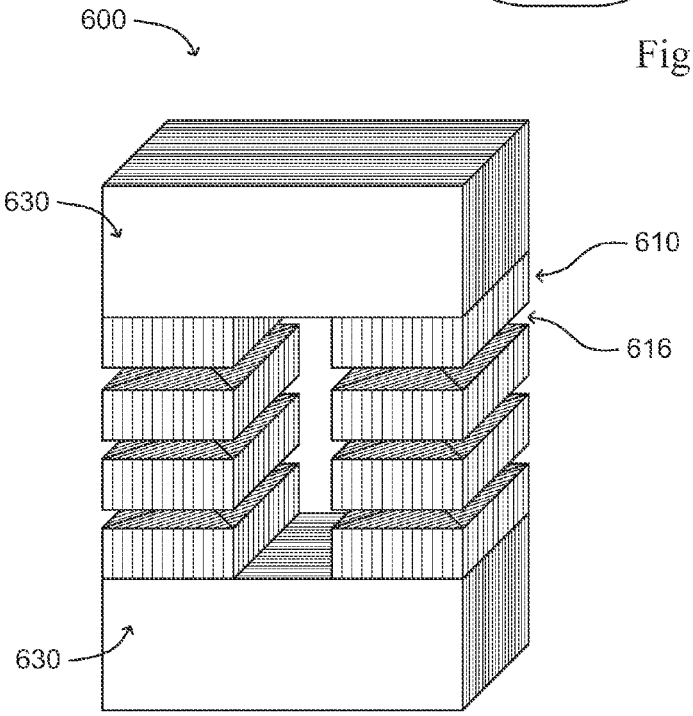
FIG. 6 illustrates how the reconfigured core embodiment of the invention of FIG. 4 may be combined with other segments cut from tape wound cores to form a complete inductor core.

This reconfigured tape wound core 450 can be incorporated into complete inductor cores in numerous ways, two of which are shown in FIGS. 5 and 6. In FIG. 5, the bar is cut into four smaller square "pucks" 510 (or four pucks are cut from the bar) which are stacked with three air gaps 516 between them, and then installed into tape wound cut cores 530 to form the complete inductor core 500. In practice, two or more pucks 510 may be utilized in the stack, with an air gap 516 between each pair of pucks. A winding (not shown for clarity of the core construction) is then placed around stack of core pucks.

In FIG. 6, the bar 450 of FIG. 4 is cut into at least eight pucks 610, from which two stacks are fabricated with air gaps 616, and assembled with two tape core bars 630 as shown to form the complete inductor core 600. In practice, two or more pucks 610 may be utilized in each stack, with an air gap 616 between each pair of pucks. A winding (not shown for clarity of the core construction) is then placed around the stacks of core pucks.

In both FIGS. 5 and 6, the cut cores 530 and the core bars 630, respectively, may have a "coupling face" or "edge surface" to which the pucks may be directly coupled. These coupling faces or edge surfaces (obscured from view by the top most or bottom most pucks) are preferably defined or made up of the edge surfaces of the layers that form the cut cores 530 or cure bars 630. While the top most or bottom most pucks are preferably coupled directly to the coupling faces, they may be spaced by a gap without departing from the present invention. The cut cores 530 or core bars 630 or the like may be regarded as supplemental core members.

Figures 7A, 7B, 7C, 7D, 7E:
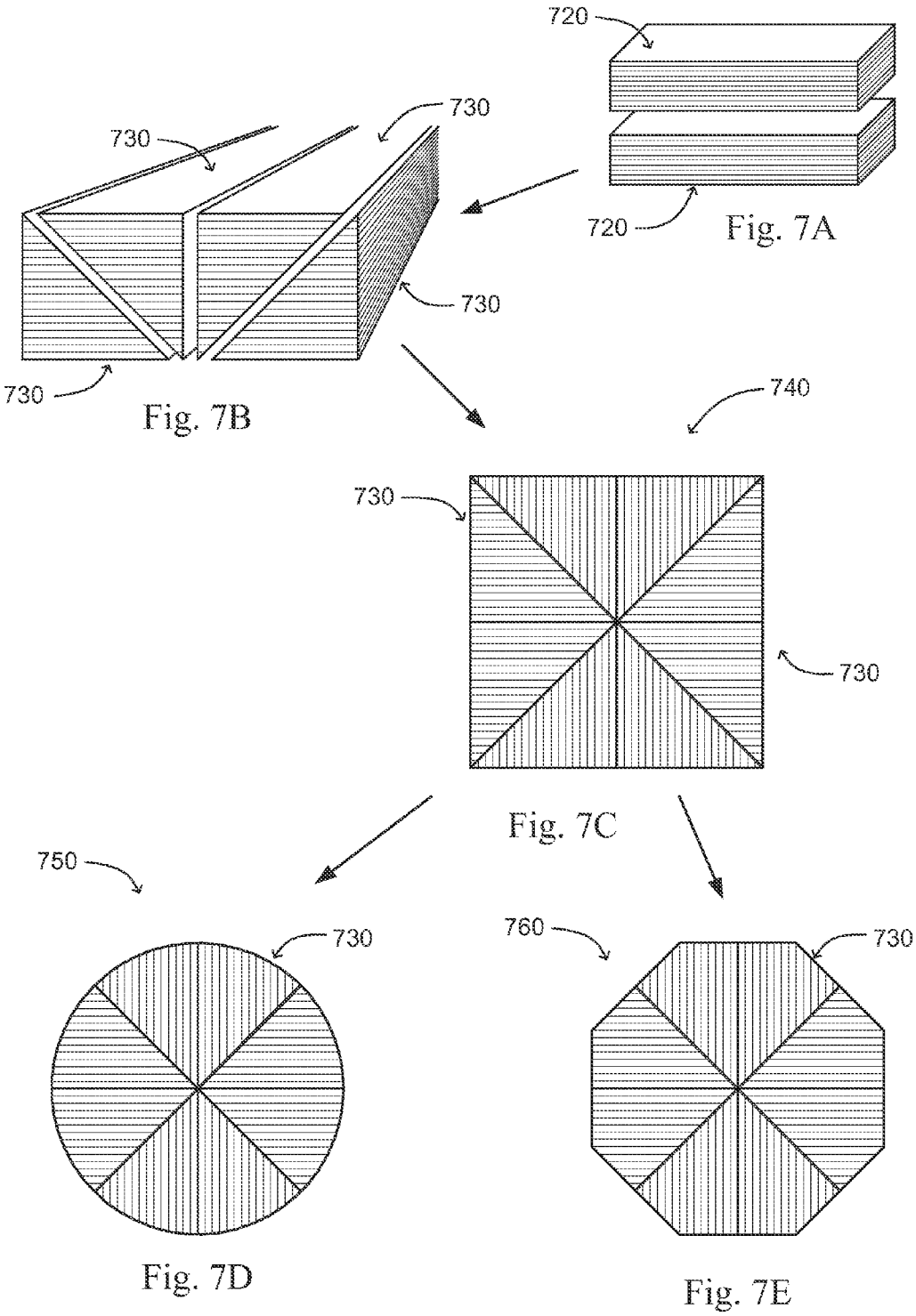
FIGS. 7A-7E is an embodiment of the present invention where a tape wound core is cut into segments and reconfigured as a round core to eliminate the eddy current losses in the core from the fringe field.

Referring to FIGS. 7A-7E, steps in accordance with another preferred embodiment of the invention for reconfiguring a tape wound core are shown. In FIG. 7A, tape core bars 720 similar to bars 420 in FIG. 4 are shown. In FIG. 7B, each bar is cut or sliced longitudinally into four right triangle shaped segments 730 of the same size. (Alternatively, a square bar similar to 720 can be cut into two right triangle shaped segments, or a wider bar may be cut into six or more triangular segments.) Eight of these segments 730 are then reconfigured into a square section 740 as shown in FIG. 7C; the triangular segments may be joined with an epoxy adhesive or other means. The square core section 740 may be cut into core pucks for assembly into complete inductor cores, as illustrated in FIGS. 5 and 6, or it may be further processed into other shapes.

In FIG. 7D, the square section 740 is machined into a round cross section bar 750, where only core tape edges are exposed at the surface of the bar. In FIG. 7E, the square bar 740 is cut into an octagonal bar 760. It should be obvious that the bar 740 may also be machined into nearly any other shape desired, such as hexagonal or oval (not shown), while retaining the benefit of only core tape edges exposed at the surface of the reconfigured bar.

Figure 8A:
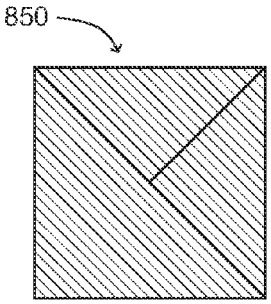
FIGS. 8A-8B illustrates how a reconfigured square core may be cut into smaller sections.
Figure 8B:
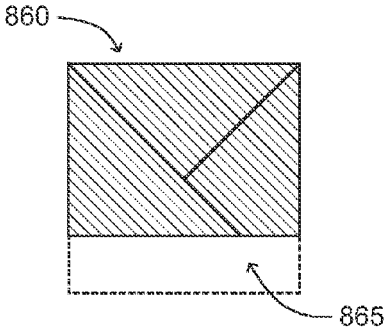

Referring to FIGS. 8A-8B, further steps in accordance with another preferred embodiment of the invention for reconfiguring a tape wound core are shown. In FIG. 8A, a reconfigured tape core bar 850 similar to 420 in FIG. 4 is shown. In FIG. 8B, the bar 850 is further cut or sliced to form a rectangular bar 860, with the removed material 865 shown in phantom. The bar 850 may be cut into other than rectangular shapes.

Figure 9A:
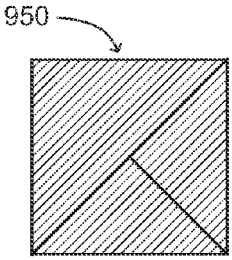
FIGS. 9A-9D illustrates how multiple reconfigured cores may be combined to form a larger core.
Figure 9C:
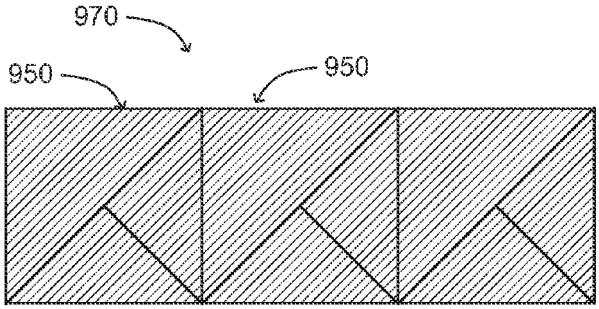
Figure 9B:
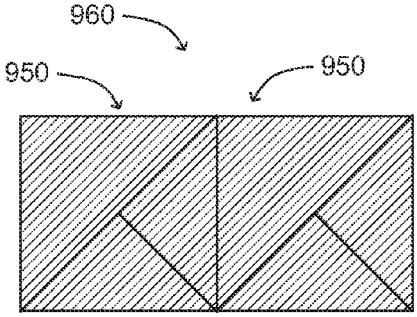
Figure 9D:
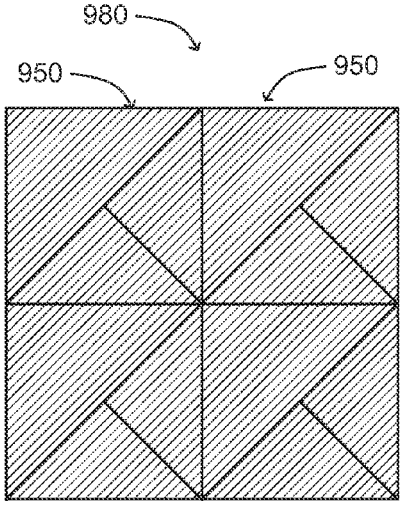

Referring to FIGS. 9A-9D, further steps in accordance with another preferred embodiment of the invention for reconfiguring a tape wound core are shown. In FIG. 9A, a reconfigured tape core bar 950 similar to 420 in FIG. 4 is shown. In FIG. 9B, two square bars 950 are assembled side-by-side to form a rectangular bar 960 of 2:1 aspect ratio and, in FIG. 9C, three such bars 950 are assembled into a rectangular bar 970 with a 3:1 aspect ratio. In FIG. 9D, for bars 950 are assembled into a larger square bar 980. Of course, larger bars may be assembled with any number of rows and columns of smaller bars 950.

Cutting a tape core bar into the said right triangle shapes generally involves the least amount of waste material, but other triangle shapes, such as equilateral triangles, may also be cut from a tape core bar and reconfigured into desired shapes without departing from the present invention.

Figures 10A, 10B, 10C, 10D, 10E:
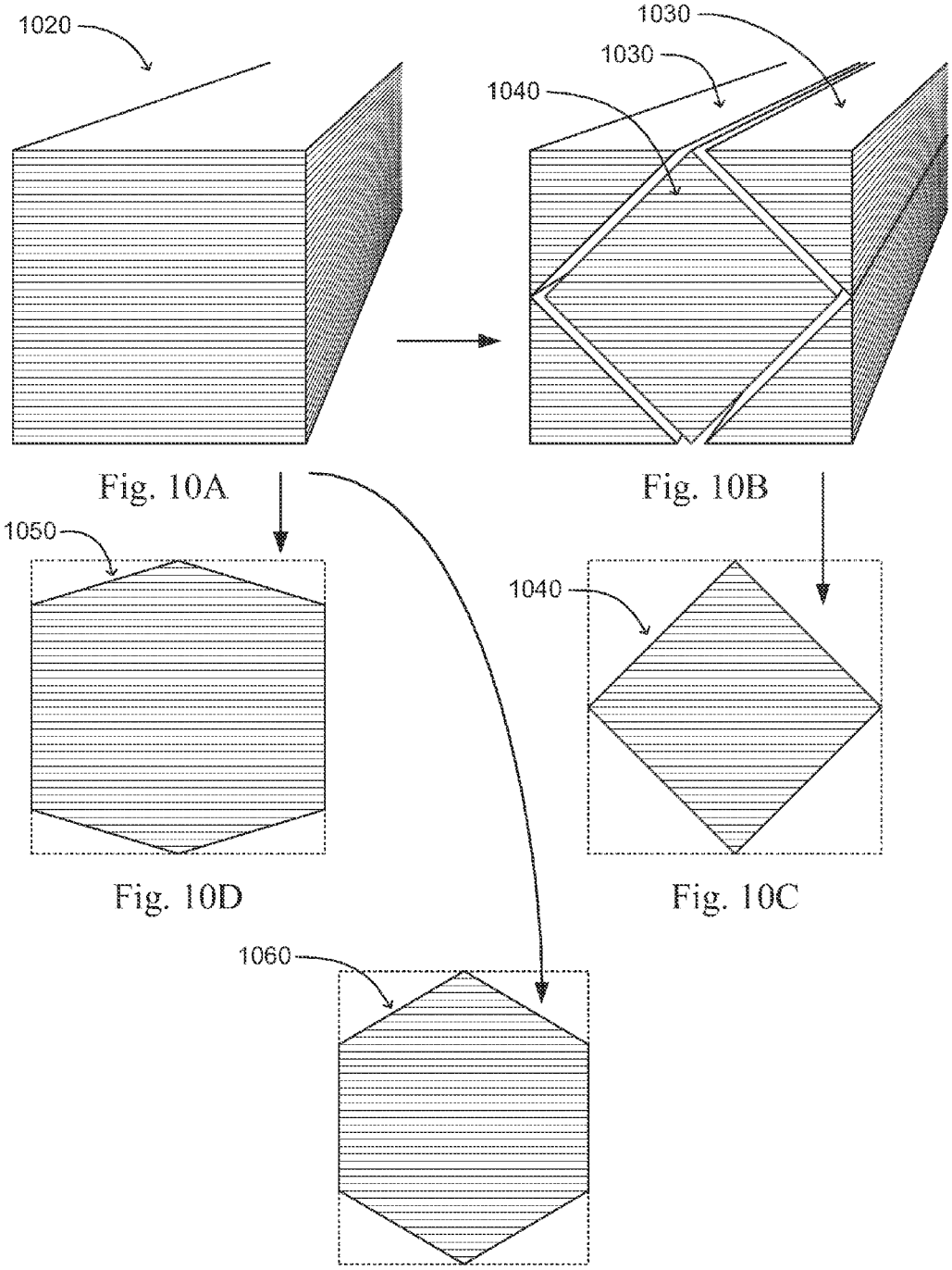
FIGS. 10A-10E illustrates how a reconfigured core may be cut directly from a tape wound core without reassembly.

Referring to FIGS. 10A-10E, steps in accordance with another preferred embodiment of the invention for reconfiguring a tape wound core are shown. In FIG. 10A, tape core bar 1020 similar to bars 420 in FIG. 4 are shown. In FIG. 10B, the bar is cut or sliced longitudinally to remove four triangle shaped segments 1030, leaving in this example a square core section 1040, shown in FIG. 10C. (Alternatively, the core material in segments 1030 may be ground away or removed by other means.) The square core section 1040 may then be cut into core pucks for assembly into complete inductor cores, as illustrated in FIGS. 5 and 6.

The tape core bar 1020 may also be cut, sliced or ground to produce cores of other lateral cross-sectional shapes. In FIG. 10D, the core bar 1020 is beveled longitudinally to expose the core tape edges in core 1050. In FIG. 10E, the bevel is increased to produce a hexagonal cross section core 1060. A core with a round cross section may also be produced. These bar segments 1040, 1050, 1060 may then be cut into core pucks like the pucks 510 and 610 of FIGS. 5 and 6.

Figures 11A, 11B, 11C, 11D, 11E:
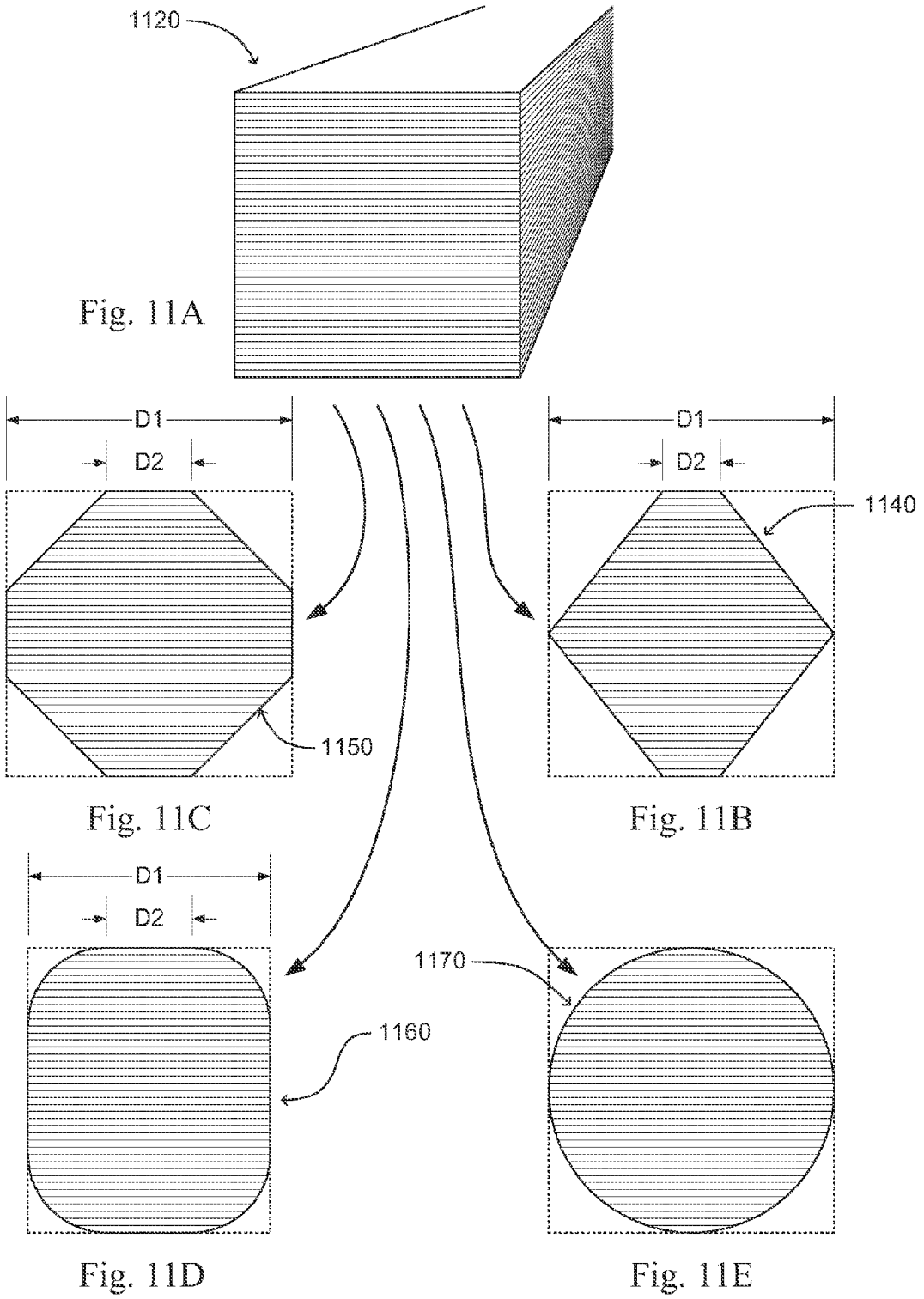
FIGS. 11A-11E are a perspective view of a tape core bar and four lateral cross-sectional views of cut/machined core bars, respectively, in accordance with the present invention.

Referring to FIGS. 11A-11E, a perspective view of a tape core bar 1120 and then four lateral cross-sectional views of cut/machined core bars in accordance with the present invention are respectively shown. FIG. 11A illustrates an initial tape core bar 1120 similar to bar 1020 of FIG. 10A. This bar may be longitudinally cut, sliced or otherwise machined to remove the corners and produce the cross-sectional shapes illustrated in FIGS. 11B-11E or related shapes. While FIGS. 10B-10E illustrate bars (and resultant pucks) with exterior surfaces defined wholly or nearly wholly by the edges of the conductive layers, the bars/pucks of FIGS. 11B-11D illustrate a portion of the broad surface retained on the exterior surface. FIG. 11E illustrates a substantially round cross section.

For example, referring to FIG. 11B (bar 1140), if D1 is the overall width of the bar, then D2, the length of the largest remaining broad surface, is shown as being approximately 25% or less of D1. Referring to FIG. 11C, D2 is larger, tending towards 30-40% or less of D1 (bar 1150) and, in FIG. 11D, D2 is larger still, tending towards 50-60% or less of D1 (bar 1160). While removing nearly all the broad surface (e.g., FIGS. 10A-10E) provides significantly enhanced performance, removing less than all of the broad surface as taught with reference to FIGS. 11B-11D improves performance over a conventional fuller broad surface.

Any of the many conventional metal-working methods might be used in cutting and shaping the cores in the current invention, including but not limited to milling, grinding, sanding, sawing, laser cutting and water jet cutting. Some of these methods may require secondary operations such as lapping and polishing to obtain a requisite smooth surface, and a final etching process may be required if primary or secondary shaping operations produce significant electrical short circuits between lamination or tape layers.

It will also be understood that the invention can be applied to inductor cores in more complex magnetic structures, including 'hybrid' or 'integrated' structures of one or more transformers and inductors. These structures include the so-called "flyback" transformer, where the transformer core contains one or more air gaps to increase energy stored in the magnetic field, effectively placing an inductance in parallel with the transformer windings. Also included are "high leakage inductance" transformers where a ferromagnetic core, with one or more air gaps, is placed between a primary and secondary winding.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features herein before set forth, and as fall within the scope of the invention and the limits of the appended claims.

REFERENCES

[1] Extract from Hill Technical Sales Corp. brochure, available at:
www.hilltech.com/products/emc_components/Amorphous_Shielding.html
[2] Extract from 'Filter Inductor Design' by Ruben Lee.
[3] Extract from "Design of Powder Core Inductors" by Hakan Skarrie
[4] "Effect of Eddy Current in the Laminations on the Magnet Field", Y. Chung and J. Galayda, Argonne National Laboratory, Argonne, Ill. 60439, LS Note No. 200, April, 1992
[5] Extract from "High Frequency Conductor Losses in Switchmode Magnetics", B. Carsten, Seminar presented for EJ Bloom Associates, Inc., and other venues.
[6] Extract from presentation on Shunt Reactors' "Shunt.1ZSE954001EN-11.pdf" by ABB Power Transmission

The invention claimed is:

1. A tape wound inductor core device, comprising:

a first core puck that is a segment of reconfigured tape wound core and includes alternating layers of conductive material and insulative material, the conductive material layers each having a broad surface and an edge surface, wherein the broad surface is the surface with the greater dimension across the layer and the edge surface is located at the edge of the broad surface; and wherein the plurality of conductive material layers are reconfigured within the tape wound puck such that the exterior surface of the puck is defined substantially by edge surfaces and the broad surfaces are situated substantially interiorly within the puck so as to not be exposed substantially on the exterior of the puck.

2. The tape wound device of claim 1, wherein the first core puck includes a first bar segment and a second bar segment, each of the first and second bar segments including a portion of said alternating layers of conductive material and insulative material;

wherein the first and second bar segments are fixedly coupled to one another.

3. The tape wound device of claim 2, wherein the alternating layers of conductive material in the first bar segment and the second bar segment are each arranged in substantially parallel planes, the parallel planes of the first bar segment layers and the parallel planes of the second bar segment layers arranged to intersect.

4. The tape wound device of claim 2, wherein the alternating layers of conductive material in the first bar segment and the second bar segment are each arranged in substantially parallel planes, the parallel planes of the first bar segment layers and the parallel planes of the second bar segment layers are arranged substantially parallel to one another.

5. The tape wound device of claim 2, wherein the first core puck comprises a third bar segment formed of a portion of the alternating layers of tape wound conductive material and insulative material, the third bar segment being fixedly coupled to the first and second bar segments, and wherein the edges of the conductive layers in the first, second and third bar segments are positioned substantially exteriorly to the first puck and the broad surfaces of the conductive layers of the first, second and third bar segments are positioned substantially interiorly to the first puck.

6. The tape wound device of claim 2, wherein the first bar segment is triangular in lateral cross-section.

7. The tape wound device of claim 1, further comprising a supplemental core member having layers of conductive and insulative material, each layer of conductive material having a broad surface and an edge surface, the conductive materials being arranged to form a first coupling face comprised substantially of edge surfaces of the layers of conductive material; and wherein the first puck is coupled to the coupling face of the supplemental core member.

8. The tape wound device of claim 1, further comprising a second core puck that is a segment of reconfigured tape wound core and is spaced from the first core puck to define an air gap therebetween, the second core puck including alternating layers of conductive material and insulative material, the conductive material layers having a broad surface and an edge surface, wherein the broad surface is the surface with the greater dimension across the layer and the edge surface is located at the edge of the broad surface; and wherein the plurality of conductive material layers of the second puck are arranged within the second puck such that the exterior surface of the second puck is defined substantially by the edge surfaces and the broad surfaces are substantially other than exposed on the exterior surface of that puck.

9. The tape wound device of claim 1, wherein the first puck has a substantially rectangular lateral cross-section.

10. The tape wound device of claim 1, wherein the first puck has a substantially non-square lateral cross-section.

11. The tape wound device of claim 1, wherein the conductive material include nanocrystalline material.

12. A tape wound inductor core device, comprising:

a first tape wound core segment including a plurality of alternating layers of tape wound conductive material and insulative material, the conductive material layers each having a broad surface and an edge surface and being arranged in substantially parallel planes, the conductive layers arranged within the first core segment so that the majority of the external surfaces of the first core segment are defined by the edge surfaces of the conductive layers;

wherein the first core segment has a maximum lateral cross-sectional dimension, D1, and wherein the length, D2, of the greatest lateral cross-sectional measure of an exteriorly disposed broad surface of one of said conductive layers is 60% or less of D1.

13. The tape wound device of claim 12, wherein D2 is 40% or less of D1.

14. The tape wound device of claim 12, wherein D2 is 25% or less of D1.

15. The tape wound device of claim 12, wherein the layers of conductive material are configured such that their broad surfaces are disposed substantially internally within the first core segment.

16. The tape wound device of claim 12, wherein the first core segment includes a first bar segment and a second bar segment, each of the first and second bar segments including some of the layers of conductive material;

wherein the first and second bar segments are fixedly coupled to one another, and wherein the parallel planes of the layers of conductive material in the first bar segment and the second bar segment are arranged substantially parallel to one another.

17. The tape wound device of claim 12, wherein the first core segment includes a first bar segment and a second bar segment, each of the first and second bar segments including some of the layers of conductive material;

wherein the first and second bar segments are fixedly coupled to one another, and the parallel planes of the layers of conductive material in the first bar segment and the second bar segment are arranged to intersect.

18. The tape wound device of claim 12, further comprising a supplemental core member having layers of conductive and insulative material, each layer of conductive material having a broad surface and an edge surface, the conductive materials being arranged to form a first coupling face comprised substantially of edge surfaces of the layers of conductive material; and wherein the first segment is coupled to the coupling face of the supplemental core member.

19. The tape wound device of claim 12, further comprising a second tape wound core segment including a plurality of alternating layers of tape wound conductive material and insulative material, the conductive material layers each having a broad surface and an edge surface and being arranged in substantially parallel planes, the conductive layers arranged within the second core segment so that the majority of the external surfaces of the second core segment are defined by the edge surfaces of its conductive layers;

wherein the second core segment is space by an air gap from the first core puck.

20. The tape wound device of claim 12, wherein the conductive material layers include nanocrystalline materials.

21. A tape wound inductor device comprising:

a first section of tape wound material including a plurality of layers of conductive material, the edges of the conductive layers forming a first edge surface;

a second section of tape wound material including a plurality of layers of conductive material, the edges of these conductive layers forming a second edge surface;

a first, a second and a third core puck that are each a segment of reconfigured tape wound core and each include a plurality of layers of conductive material, each conductive material layer having a broad surface and an edge surface, where the broad surface is the surface with the greater dimension across the layer and the edge surface is located at the edge of the broad surface, and wherein a substantial majority of the exterior surface of the first, second and third core pucks is defined by the edge surfaces of the tape wound layers of conductive material in the respective puck;

wherein the first core puck is directly coupled to the first edge surface of the first tape wound section, the second core puck is directly coupled to the second edge surface of the second tape wound section, and the third core puck is situated between and separated by an air gap from the first and second core pucks.

22. The tape wound device of claim 21, wherein the third core puck as a maximum lateral cross-sectional dimension, D1, and a largest lateral cross-sectional measure of an exteriorly disposed broad surface of one of the conductive layers, D;

wherein D2 is one-half or less of D1.

23. The tape wound device of claim 22, wherein D2 is one-third or less of D1.

24. The tape wound device of claim 21, wherein the layers of conductive material of the third core puck are configured such that their broad surfaces are disposed substantially internally within the third core puck.

25. The tape wound device of claim 21, wherein at least one of the first, second and third core pucks includes nanocrystalline materials.

* * * * *